United States Patent [19]

Mikuni et al.

[11] 4,424,758

[45] Jan. 10, 1984

[54] EMBROIDERING APPARATUS FOR USE WITH SEWING MACHINES

[75] Inventors: Yoshio Mikuni; Tadao Kohara, both of Osaka; Yoshihide Yoneda, Hirakata, all of Japan

[73] Assignee: Maruzen Sewing Machine Company, Osaka, Japan

[21] Appl. No.: 323,454

[22] Filed: Nov. 20, 1981

[30] Foreign Application Priority Data

| | | | |
|---|---|---|---|
| Jun. 16, 1981 | [JP] | Japan | 56-89206[U] |
| Jun. 16, 1981 | [JP] | Japan | 56-89207[U] |
| Jun. 16, 1981 | [JP] | Japan | 56-89208[U] |
| Jun. 16, 1981 | [JP] | Japan | 56-89209[U] |
| Jun. 16, 1981 | [JP] | Japan | 56-93517 |
| Jun. 16, 1981 | [JP] | Japan | 56-93518 |

[51] Int. Cl.[3] ..... D05C 9/04

[52] U.S. Cl. ..... 112/103; 112/121.12; 112/309

[58] Field of Search ..... 112/103, 102, 86, 90, 112/121.12, 121.11, 309; 38/102.2; 33/23 R, 23 B, 23 E, 23 H; 409/86, 87, 88

[56] References Cited

U.S. PATENT DOCUMENTS

| | | | |
|---|---|---|---|
| 1,159,901 | 11/1915 | Corrall et al. | 112/103 |
| 2,806,440 | 9/1957 | Schenkengel | 112/103 |
| 2,894,468 | 7/1959 | Nohl . | |
| 2,989,015 | 6/1961 | Taketomi | 112/103 |
| 3,082,721 | 3/1963 | Bono . | |
| 4,181,063 | 1/1980 | Burry | 409/88 |
| 4,195,581 | 4/1980 | Ohara . | |

FOREIGN PATENT DOCUMENTS

| | | | |
|---|---|---|---|
| 1332868 | 10/1973 | United Kingdom | 38/102.2 |

*Primary Examiner*—Werner H. Schroeder
*Assistant Examiner*—Andrew M. Falik
*Attorney, Agent, or Firm*—Lowe, King, Price & Becker

[57] ABSTRACT

An embroidering apparatus for use with a sewing machine has a body supported on a bed and movable back and forth and laterally along guide rails extending perpendicularly to each other. A table and a support frame to which an embroidery frame is attachable are mounted on the body for movement therewith. A fixed tracing needle is oriented to the table on which an original pattern is to be placed. In operation, the table can be manipulated to permit the tracing needle to follow the original pattern on the table while the latter is being moved around. For certain pattern configurations locking or stop devices are employed for selectively locking the table and support frame against rotation or for constraining the frame to only rectilinear movement.

37 Claims, 22 Drawing Figures

EMBROIDERING APPARATUS FOR USE WITH SEWING MACHINE

BACKGROUND OF THE INVENTION

1. Field of the Invention

The present invention relates to an embroidering apparatus mountable on a sewing machine bed.

This invention is an improvement upon the invention of U.S. patent application Ser. No. 323,453, filed on the same date, entitled "Embroidering Apparatus for Use with Sewing Machines", and commonly owned.

2. Description of the Prior Art

Known embroidering apparatus comprises a fixed rail mounting on a sewing machine frame, a movable rail extending in criss-cross relation to the fixed rail, and an embroidery frame movable back and forth and laterally along the fixed and movable rails. A piece of cloth, on which a pattern is drawn duplicating an original pattern, is placed under tension on the embroidery frame, which is manually moved around so as to allow a sewing needle as it moves up and down to follow the pattern on the piece of cloth. It is not an easy task to pattern a figure in detail after duplicating a model on the cloth as correctly as the operator desires, for there is always a tendency for the pattern to be drawn somewhat differently from the model pattern. Another disadvantage with the prior embroidering apparatus is that is is difficult to move the embroidery frame in order for the needle to pierce the cloth exactly at desired positions, resulting at times in embroidered works which are not patterned after the model.

Another type of embroidering apparatus comprises a tracing needle which traces a fixed original pattern while the tracing needle is moving with an embroidery frame. Such embroidering apparatus is disclosed in U.S. Pat. No. 2,894,468, issued July 14, 1959 to Walter Nohl, for example. The embroidery frame may be either movable back and forth and laterally along crossing rails, or supported on a pantograph mechanism of parallel links which is expansible and contractable for allowing back-and-forth and lateral movements of the embroidery frame. The tracing needle is attached to a rod extending from the embroidery frame for movement therewith. In operation, the rod is gripped at an end portion thereof adjacent to the tracing needle and moved so as to enable the latter to follow the original pattern. With this arrangement, it is not necessary to draw a pattern on a piece of cloth duplicating the original, and the patterning can be effected easily and reliably as the tracing needle follows the original while kept in contact therewith or closely thereto. However, since the tracing needle and the embroidery frame move in unison, leftward movement of the tracing needle causes the sewing needle to be located rightward in the embroidery frame and forward movement of the tracing needle causes the sewing needle to be located rearwardly in the embroidery frame, making an embroidered pattern look inverted. Such an inverted pattern renders it quite difficult for the operator to ascertain whether the original model is being followed accurately while in the embroidering operation. There has been known an apparatus having a mechanism for orienting an embroidered work in the same direction as the original pattern. Inclusion of such an additional mechanism makes the apparatus complex in construction. Furthermore, since the rod is relatively slender and flexible, it tends to flex due to frictional resistance between the cloth placed on the embroidery frame and a throat plate, with the results that movement of the embroidery frame will not correctly reflect that of the tracing needle, and hence the resultant embroidered pattern will not look much like the original pattern.

The prior embroidering apparatus as described above are designed to embroider a piece of cloth only with stitches in one and the same directions, and are unable to produce embroidery works with stitches in any different directions, such as a pattern of fur of an animal. To cope with this, there have been devised embroidering apparatus having an embroidery frame that is rotatable as well as movable back and forth and laterally to produce an embroidered pattern with varying stitches. One such embroidery apparatus is manually actuatable, while the other is electrically controllable. The former type is disclosed in U.S. Pat. No. 3,082,721, issued Mar. 26, 1963 to Luigi Bono, and the latter type is disclosed in U.S. Pat. No. 4,195,581, issued Apr. 1, 1980 to Naoki Ohara, for example. The manually operable apparatus has suffered from problems in that a pattern is required to be drawn on a piece of cloth after a model, a procedure which can produce a rough contour of the model but fails to transfer exactly the same pattern to the cloth, and hence the original pattern, the figure drawn on the cloth and the embroidered pattern are likely to look different. Furthermore, the operator should be trained and skilled sufficiently in rotating, moving back and forth, and moving laterally the embroidery frame or a support frame therefor at the same time. Otherwise, embroidering a pattern exactly after a model would not be possible. The electrically-operated embroidering apparatus comprises an actuator including three pulse motors for rotating, moving back and forth, and moving laterally an embroidery frame, and a control unit for electrically controlling the pulse motors. The embroidering apparatus is thus quite complex in structure and expensive to construct.

SUMMARY OF THE INVENTION

It is an object of the present invention to provide an embroidering apparatus for use with sewing machines which comprises a table for placing thereon an original pattern, an embroidery frame operatively connected to the table for back-and-forth and lateral movement therewith, and a fixed tracing needle oriented to the table, so that the table can be moved in order for the fixed tracing needle to follow the original pattern.

In one arrangement, the table and the embroidery frame may be movable back and forth and laterally by runners rollingly movably mounted on crossing rails, and the runners may be locked by stoppers on the rails against movement therealong.

The stoppers may comprise caps movably mounted on the rails and capable of sandwiching the runners therebetween against movement along the rails. Alternatively, the stoppers may be mounted on the runners and comprise cams angularly rotatably supported on the runners and actuatable by handle levers into pressing engagement with the rails for securing the runners to the rails.

The pantograph mechanism is advantageous in that if allows the apparatus to move more smoothly than the rail-mounted apparatus.

Another object of the present invention is to provide an embroidering apparatus for use with sewing machines which can produce embroidered works having varying stitches by rotating, moving back and forth, and moving laterally a table on which an original pattern is placed. Their angular velocities are the same at all times, and the tracing needle is directed toward the axis of rotation of the table when the sewing needle points at the center of rotation of the embroidery frame, so that the embroidery frame and the table are always in angular agreement irrespective of an angular position of an original pattern on the table. If the angular velocities of the table and the embroidery frame were different, they would rotate at different rates and shift embroidering stitches out of agreement with the original pattern. In addition, if the sewing and tracing needles were not spaced equidistantly from the respective axes of rotation of the table and the embroidery frame, the needles would describe arcs of different lengths on the table and the embroidery frame as they rotate through the same angle, resulting in an embroidered pattern different from the original pattern.

The table is preferably coupled by a power transmitting device to a support frame to which the embroidery frame is attached, though rotative power may be transmitted from the table directly to the embroidery frame by a power transmitting device such as a belt drive device, a gear drive device, or a friction drive device.

According to an embodiment of the present invention, a pair of guide rails are fixedly mounted on sides of a body which supports thereon a table and an embroidery frame, the guide rails being movably supported on runners secured to ends of another guide rail extending normally to the pair of guide rails. The latter guide rail is movably supported on a runner attached to a fixed member secured to a presser bar of a sewing machine.

The guide rail engaging the runner to which the fixed member is attached may be of a circular cross section and may be rotatably mounted on the runner, so that the body is angularly movable with respect to the fixed member.

According to still another embodiment, the body is connected to a member fixed to the presser bar through a pantograph mechanism comprising parallel links.

In the foregoing embodiments, a tracing needle is fixed to an end portion of a rod which is secured to the presser bar, a sewing machine frame, the guide rail or a fixed member secured to the presser bar.

According to still another feature, there is provided a locking device for stopping rotation of an embroidery frame which is rotatable and movable back and forth and laterally, allowing the embroidering apparatus to produce an embroidery work with stitches in one and the same directions or stitches in any different directions. The locking device is selectively movable between positions, one for allowing movement of and the other for disabling the embroidery frame, power transmitting device, or table. The braking device may comprise a roller pressable against or a pointed projection movable into biting engagement with the embroidery frame, power transmitting device, or table.

Still another feature of the present invention is that the embroidery frame can simply and easily be attached to or detached from the support frame.

The above and other objects, features and advantages of the present invention will become apparent from the following description when taken in conjunction with the accompanying drawings which show preferred embodiments of the present invention.

DESCRIPTION OF THE PREFERRED EMBODIMENTS

Figure 1:
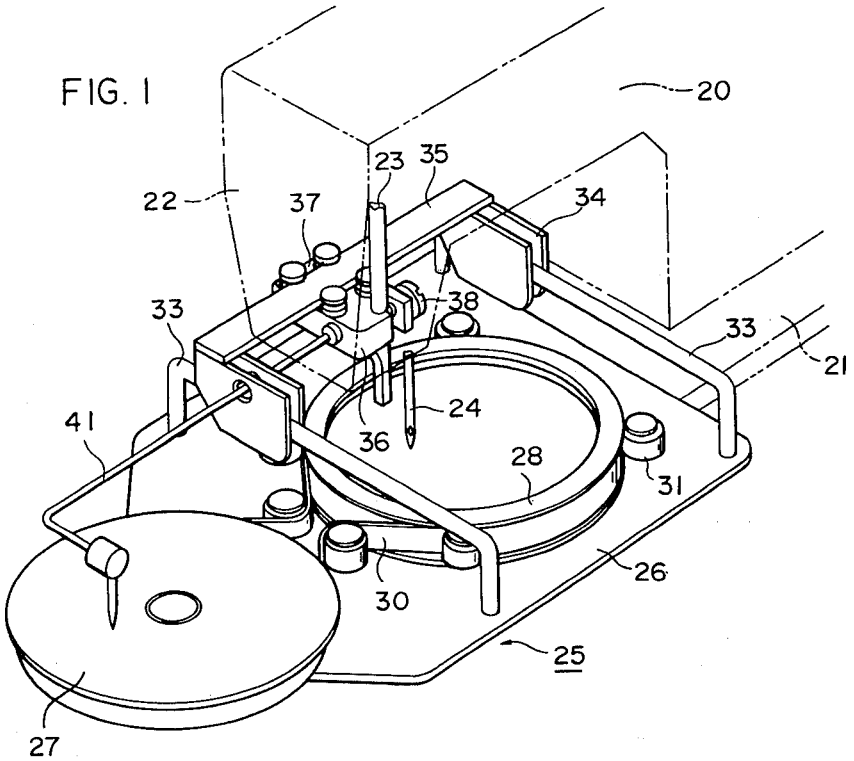
FIG. 1 is a fragmentary perspective view of a sewing machine equipped with an embroidering apparatus.

As shown in FIG. 1, a sewing machine 20 comprises a bed 21 and a head 22 which supports a presser bar 23 and a needle 24. An embroidering apparatus according to the present invention is mounted on the bed 21, the embroidering apparatus being generally indicated at the reference numeral 25.

Figure 4:
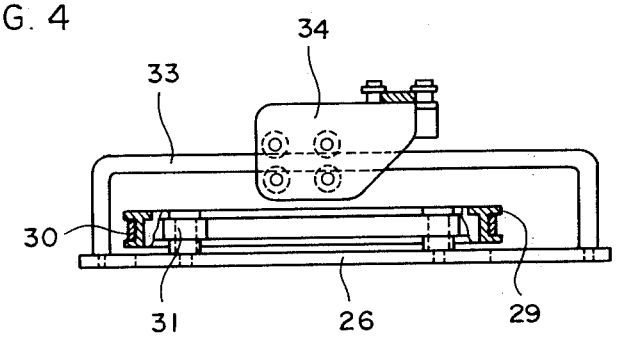
FIG. 4 is a side elevational view of the embroidering apparatus with a belt, and a support frame shown partly in cross section.
Figure 2:
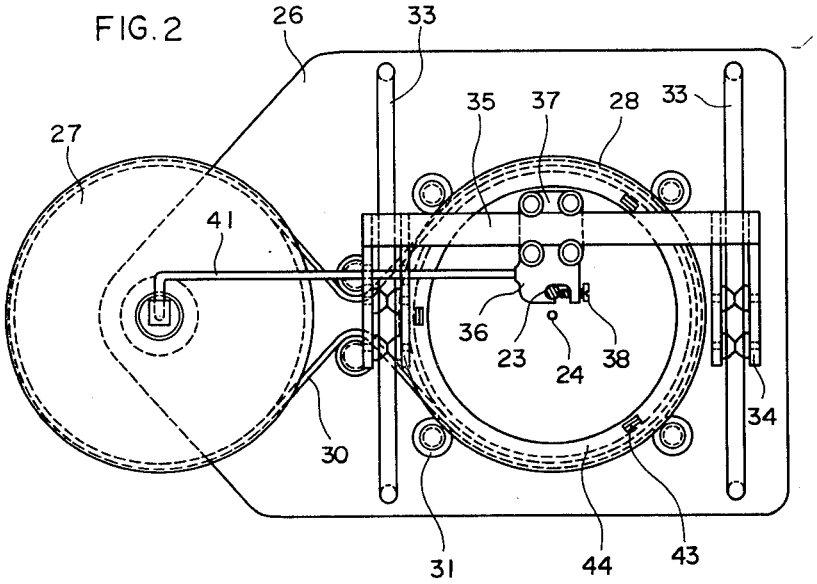
FIG. 2 is a plan view of the embroidering apparatus shown in FIG. 1 with fixed member secured to a presser bar.
Figure 3:
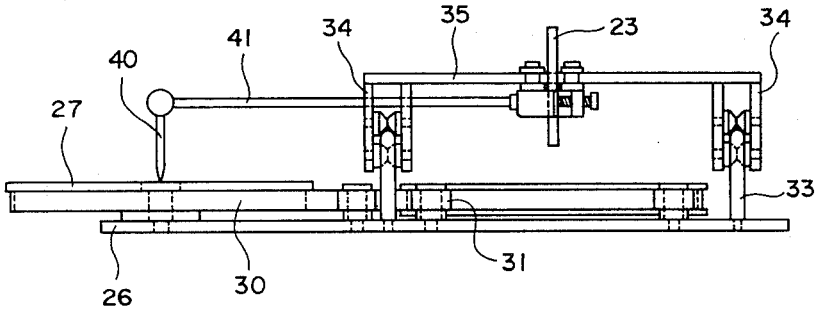
FIG. 3 is a front elevational view of the embroidering apparatus.

As illustrated in FIGS. 2 through 4, the embroidering apparatus 25 comprises a body 26 on which a circular table 27 is journalled for placing and fixing thereon an original pattern, and an annular support frame 28 is rotatably mounted. Each of the table 27 and the frame 28 has a peripheral groove 29 receiving therein an endless belt 30, or preferably a timing belt, which extends around the table 27 and the frame 28 for their rotation, or for transmitting rotative power from the table 27 to the support frame 28, the table 27 and the support frame 28 having the same diameter where the belt 30 engages them. The support frame 28 is rotatably mounted on the body 26 by a plurality of rollers 31 rotatably supported on the body 26 at spaced locations and held in engagement with the belt 30 disposed around the support frame 28.

Figure 5:
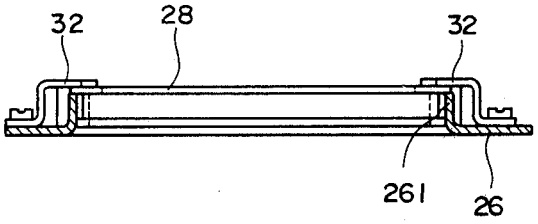
FIG. 5 is an elevational view, partly in cross section, of a support frame rotatably supported by a modified structure.
Figure 6:
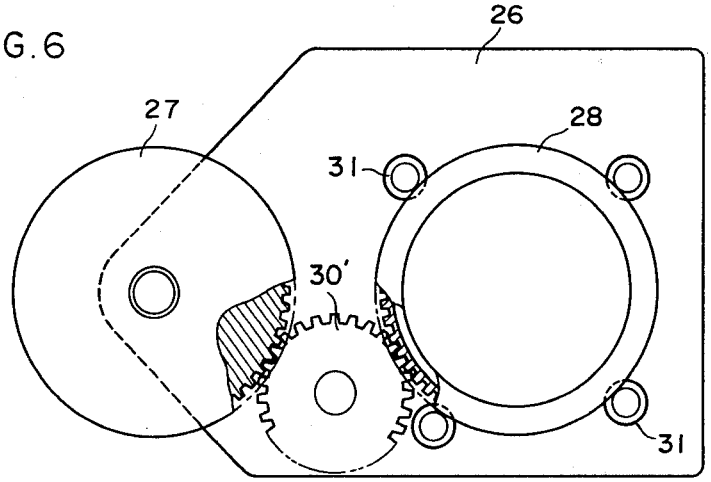
FIG. 6 is a fragmentary plan view of a table and a support frame rotatably coupled through a gear drive.
Figure 7:
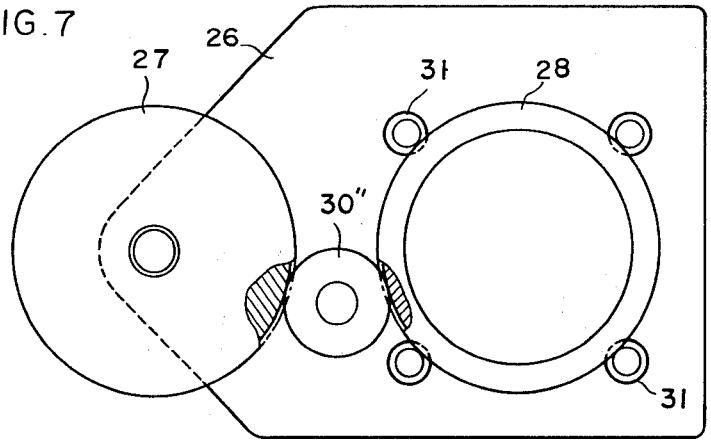
FIG. 7 is a fragmentary plan view of a table and a support frame rotatably coupled through a friction drive.

According to another embodiment illustrated in FIG. 5, the support frame 28 is rotatably fitted in a cylindrical member 261 integral with the body 26. A holder 32 is preferably mounted on the body 26 and holds the support frame 28 at its upper surface to prevent the support frame 28 from being accidentally displaced upwardly. Rotative power may be transmitted from the table 27 to the support frame 28 by a gear drive device 30' (FIG. 6) or a friction drive device 30'' (FIG. 7).

A pair of parallel rails 33, 33 is fixed to an upper surface on the body 26 and disposed one of each side of the support frame 28. A transverse rail 35 supports on ends thereof a pair of runners 34, 34 which are rollingly mounted on and support the rails 33, 33, respectively. The rail 35 is supported on a runner 37 secured to a fixed member 36 for rolling movement relative to the runner 37, the fixed member 36 embracing at an end thereof and being secured to the presser bar 23 by a set screw 38.

The body 26 is thus movable horizontally omnidirectionally, or in longitudinal directions of the rails 33, 35, across an extent which is large enough to cover the diameter of an embroidery frame (later described) mounted on the support frame 28. Conventional sewing machines have a sufficient space available for the support frame to move within the foregoing extent during embroidering operation. The embroidering apparatus 25 is oriented with respect to the sewing machine 20 such that the longitudinal axis of the apparatus 25 extending through the centers of the table 27 and support frame 28 is directed along the longitudinal direction of the bed 21. With such orientation of the embroidering apparatus 25, the operator can watch equidistantly the original pattern on the table 27 and an embroidery being formed in the embroidery frame with the needle 24 right before her, resulting in a facilitated embroidering operation. In addition, the embroidering apparatus 25 thus directed on the sewing machine 20 allows unobstructed insertion and removal of a bobbin into and out of the sewing machine 20.

When attaching the fixed member 36 to the presser bar 23, it is required that the fixed member 36 lie parallel to the bed 21. Had the fixed member 36 been inclined with respect to the bed 21, the runners 34, the rail 33, and the body 26 would also be inclined with respect to the bed 21, causing a piece of cloth attached to the embroidery frame to be either spaced upwardly away from a throat plate with a resultant skip stitch, or pressed against the bed 21 and subjected to sluggish movement, which prevents the embroidering apparatus 25 from moving smoothly. In attaching the fixed member 36 to the presser bar 23, therefore, the fixed member 36 is positionally adjusted several times with respect to the presser bar 23 while the operator moves the embroidering apparatus around to see if it lies in a horizontal plane, a procedure which is quite tedious and time consuming, however.

Figure 8:
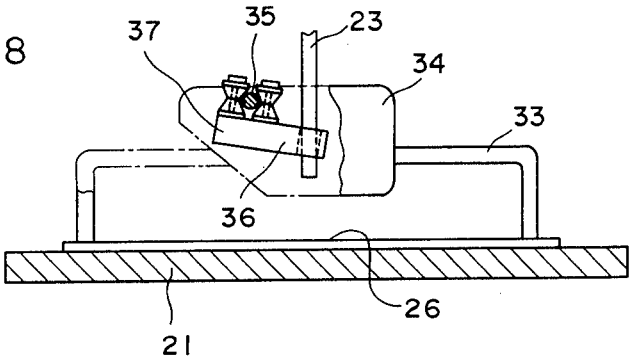
FIG. 8 is a side elevational view of the embroidering apparatus with the fixed member attached to the presser bar in an inclined position.

To avoid such a complicated adjustment operation, the rail 35 may be of a circular cross section as shown in FIG. 8, and may be rotatably mounted on either the runner 37 or the runners 34. With this arrangement, the runners 34 are permitted to follow the rails 33 on the body 26 mounted on the bed 21 until the runners 34 lie parallel to the bed 21 even when the fixed member 36 extends at an angle to the bed 21. No positional adjustment is thus rendered necessary when the fixed member 36 is attached, as inclined, to the presser bar 23 at a slightly lowered position thereon, as illustrated in FIG. 8.

The fixed member 36 may be shorter than illustrated in FIG. 2 provided it can support the runner 37 and can be secured to the presser bar 23. The shorter fixed member 36 is advantageous in that the space taken up by the embroidering apparatus 25 can be smaller since the fixed member 36 and the runner 37 will not project beyond the peripheral edges of the body 26 when the body 26 is moved until the inner edge of the embroidery frame gets close to the needle 24.

A rod 41 is secured at one end to the fixed member 36 and has at the other end a tracing needle 40 directed toward the table 27. The tracing needle 40 is so positioned that it points to the center of rotation of the table 27 when the needle 24 is directed to the axis of rotation of the support frame 28.

Figure 9:
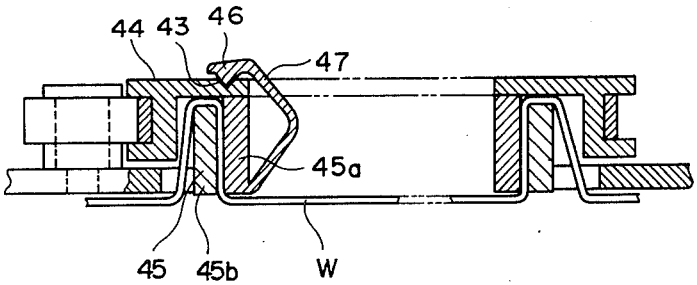
FIG. 9 is an enlarged cross-sectional view of an embroidery frame attached to the support frame.

As shown in FIG. 9, the support frame 28 is preferably made of synthetic resin and includes a plurality of attachment projections 44 circumferentially spaced from each other and each having in its upper surface a notch 43. The embroidery frame 45 comprises an inner frame member **45*a* and an outer frame member 45*b*, both made of synthetic resin, the inner frame member 45*a* having a plurality of flexible clips 47 of synthetic resin which positionally correspond respectively to the attachment projections 44 and include prongs 46 that can fit in the notches 43. the attachment projections 44 are engaged by the clips 47 to hold down the embroidery frame 45**, and should have such an extent of projection as to be able to accommodate embroidery frames of various diameters.

When the embroidery frame 45 is to be attached to the support frame 28, a piece of cloth W as stretched is held against the inner frame member **45*a* or the outer frame member 45*b*, and the inner frame member 45*a* is fitted in the outer frame member 45*b* with the piece of cloth W sandwiched therebetween. Then, the assembled embroidery frame 45 is inserted into the support frame 28 until the former abuts against the attachment projections 44, and the embroidery frame 45 is turned until the clips 47 are brought into positional alignment with the attachment projections 44. The clips 47 are now pushed radially outwardly to force the prongs 46 into the notches 43. As an alternative, the support frame 28 has an attachment projection extending continuously along the entire internal edge of the support frame and having a notch in its surface, an arrangement which makes it possible to attach the embroidery frame to the support frame 28** in any desired angular relation to the latter.

When it is necessary to attach the embroidery frame 45 to or remove the same from the support frame 28 after the fixed member 36 has been secured to the presser bar 23 and the embroidering apparatus 25 has been mounted on the sewing machine 20, the presser bar 23 is first lifted to raise the embroidering apparatus 25 away from the bed 21, and then embroidery frame 45 is inserted or removed through a clearance formed between the bed 21 and the body 26 as elevated.

Figure 10:
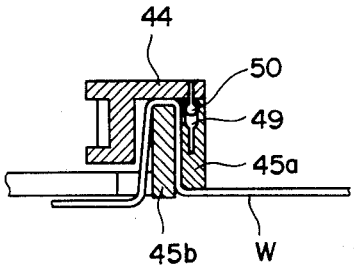
FIG. 10 is an enlarged cross-sectional view of a modified embroidery frame attached to the support frame.

According to a modification shown in FIG. 10, an inner frame member 45*a* has in its upper surface a slot 49, and a support frame 28 has on its inner peripheral edge a plurality of attachment projections 44 or a single continuous attachment projection 44 supporting thereon a plurality of protuberances 50 or a continuous ridge 50 directed downwardly and forcibly inserted in the slot 49. Alternatively, the piece of cloth W may be pinned to the embroidery frame 45 in which case the latter may be of an integral structure and separate inner and outer frame members may be dispensed with.

Although not shown, the piece of cloth W may be retained in place by being forcibly sandwiched between the interfitting embroidery frame and the support frame. Such an arrangement requires no attachments to hold the embroidery and support frames together, but it is preferable that one of the embroidery and support frames has some means which engage the other so that the embroidery frame will not accidentally be displaced out of the support frame.

In operation of the embroidering apparatus 25, an original pattern is fixedly placed on the table 27 which is then supported by hand, and, as the sewing machine 20 operates, the table 27 is manually rotated and the body 26 is moved back and forth and laterally for causing the needle 40 to trace the pattern on the table 27. The embroidering apparatus 25 of the present invention can be operated with greater ease than conventional embroidering apparatus in which an embroidery frame needs to be rotated and moved to and fro in various directions.

The embroidering apparatus constructed can produce an embroidery work having stitches in any different directions by rotating the embroidery frame during operation. It is however difficult to embroider a piece of cloth with stitches in one and the same directions simply by holding the table by hand against rotation since the table is liable to turn when the body 26 is moved around.

Figure 11A:
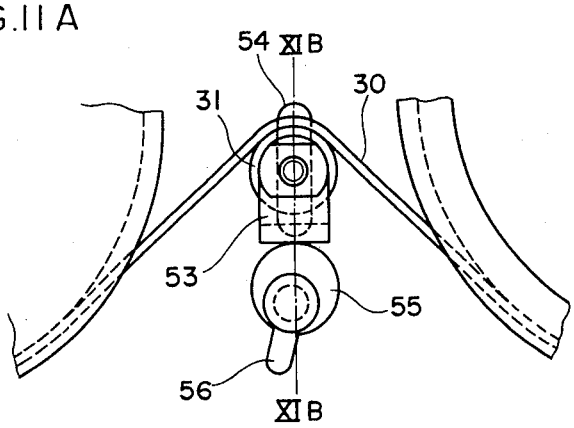
FIG. 11A is an enlarged plan view of a locking device for the embroidery frame.
Figure 11B:
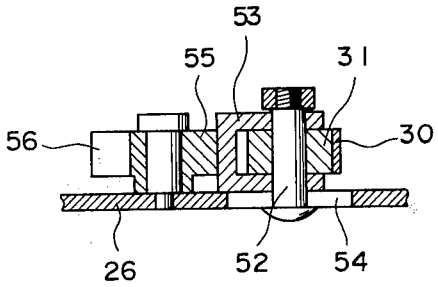
FIG. 11B is an enlarged cross-sectional view taken along line XIB—XIB of FIG. 11A.

To eliminate the above difficulty, a locking device for limiting rotation of the table may be employed. More specifically, as illustrated in FIGS. 11A and 11B, one of a pair of rollers 31 which engage the belt 30 between the table 27 and the support frame 28 is mounted for rotation on a pin 52 slidably received in a slot 54 in the body 26 and supporting a channel-shaped member 53 in which the roller 31 is rotatably disposed. An eccentric cam 55 is rotatably mounted on the body 26, and the channel-shaped member 53 is held at its back against the eccentric cam 55 under the tension of the belt 30. The eccentric cam 55 has a handle 56 which, when actuated, turns the eccentric cam 55 to move the channel-shaped member 53 and hence the roller 31 back and forth along the slot 54. When the channel-shaped member 53 is lifted upward by the cam 55 to cause the roller 31 to make the belt 30 tighter, the table 27 and the support frame 28 are fastened by the belt 30 to the point where they are prevented from rotation. Retraction of the channel-shaped member 53 permits the belt 30 to get loosened, whereupon the table 27 and the support frame 28 are rendered rotatable. Preferably, the channel-shaped member 53 may have on its back a ridge, and the peripheral cam may have in its cam surface grooves receptive therein of the ridge when the roller 31 is pushed forward and backward, respectively. With such a locking device, the table 27 and the support frame 28 can selectively be locked against rotation or rendered freely rotatable.

Figure 12A:
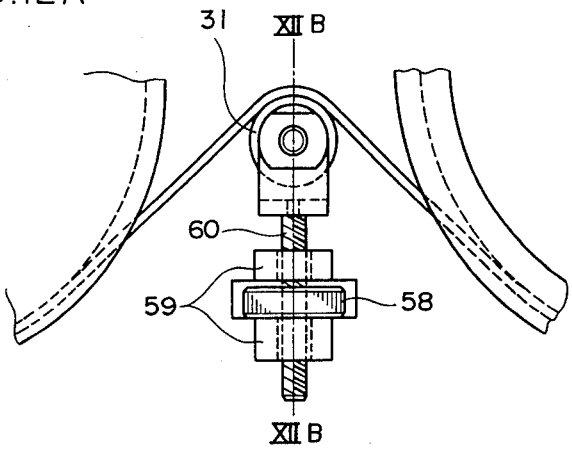
FIG. 12A is an enlarged plan view of a locking device according to another embodiment.
Figure 12B:
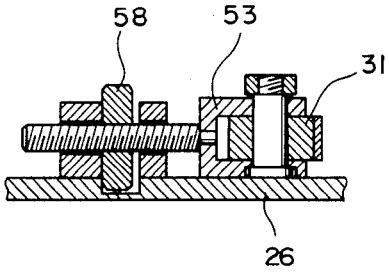
FIG. 12B is an enlarged cross-sectional view taken along line XIIB—XIIB of FIG. 12A.

FIGS. 12A and 12B illustrate a locking device according to another embodiment in which the body 26 supports thereon a pair of spaced projections 59 having holes through which extends a threaded rod 60 secured at one end thereof to a channel-shaped member 53 in which a roller 31 is rotatably mounted. A dial or adjustment nut 58 is threaded on the rod 60 and located between the projections 59. Turning the dial 58 causes the channel-shaped member 53 to move back and forth on the body 26, whereupon the roller 31 tightens or loosens the belt to lock or free the table 27 and the support frame 28. The roller 31 can be moved back and forth for small intervals to enable fine adjustment of tension of the belt.

The roller 31 may be rotatably mounted on an end of a bell crank or lever pivotally mounted at its center on the body 26. The other end of the bell crank or lever can be angularly moved to shift the roller 31 in order to increase or reduce the tension of the belt, and should preferably be able to be held at a desired position in a manner well known in the art.

Figure 13:
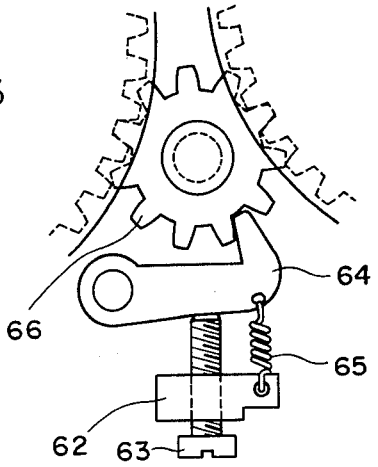
FIG. 13 is an enlarged plan view of a locking device according to still another embodiment.

FIG. 13 shows a locking device for locking a table and a support frame which are operatively connected by a gear drive device for transmitting rotative power from the table to the support frame. The locking device comprises a bolt 63 extending threadedly through a projection 62 mounted on the body, a ratchet 64 rotatably supported on the body, and a spring 65 resiliently held against an end of the bolt 63 for biasing the ratchet 64 toward the projection 62. Rotation of the bolt 63 for axial movement thereof through the projection 62 causes the ratchet 64 to move into and out of engagement with a transmission gear 66, thus allowing the support frame to be fixed and rotatable, respectively.

The embroidering apparatus 25 is movable freely in a desired direction due to combined motion of the body 26 that travels along the directions in which the rails 33, 35 extend. There are occasions in which the piece of cloth should be embroidered with stitches along a straight line by moving the embroidering apparatus 25 only in a back-and-forth direction or in a lateral direction. However, the apparatus 25 tends to move around in undesired directions even if the operator attempts to move the embroidery frame rectilinearly in one direction, resulting in a failure to embroider the piece of cloth along a desired straight-line direction.

Figure 14:
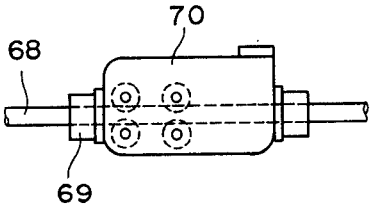
FIG. 14 is an enlarged front elevational view of a runner secured by stoppers to a rail.

The above difficulty can be eliminated by securing the runner to the rail with a stopper at any desired position on the rail. One such stopper comprises a cap 69 mounted slidably on a rail 68 as shown in FIG. 14, the cap 69 being of a resilient tubular configuration formed of rubber or plastics. Two of such caps 69 are fitted over the rail 68 and held against opposite ends of a runner 70 to sandwich and keep the latter in a desired position on the rail 68 against movement therealong.

Figure 15:
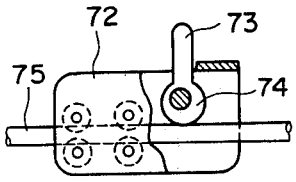
FIG. 15 is an enlarged front elevational view, partly broken away, of a runner secured by a different stopper to a rail.

FIG. 15 illustrates an alternative embodiment in which a runner 72 has a cam block 74 rotatably disposed therein and having a handle lever 73 projecting out of the runner 72, the cam block 74 preferably comprising a resilient eccentric cam made of rubber of plastics. The runner 72 is to be fixed in position on a rail 75, when the handle lever 73 is turned until the cam block 74 is pressed against the rail 75. The cam block 74 may be replaced with a pointed projection which can be turned into biting engagement with the rail 75.

Figure 16:
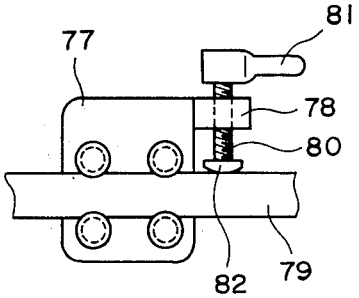
FIG. 16 is a view of another runner secured by a stopper.

According to still another embodiment shown in FIG. 16, a runner 77 has an arm 78 projecting therefrom and through which threadedly extends a threaded rod 80 directed to a rail 79 and having a handle 81 secured thereto for rotating the rod 80 about its own axis. The runner 77 can be fixed in position by turning the handle 81 to advance the threaded rod 80 until its end is pressed against the rail 79. A resilient cap 82, preferably of synthetic resin or rubber, is mounted on the end of the threaded rod 80 to prevent the latter from biting into and hence damaging the rail 79.

With the runners thus secured in position, the embroidering apparatus 25 is prevented from accidentally sliding and breaking the sewing needle 24 when the sewing machine is tilted for insertion and removal of the bobbin or is carried around.

Figure 17:
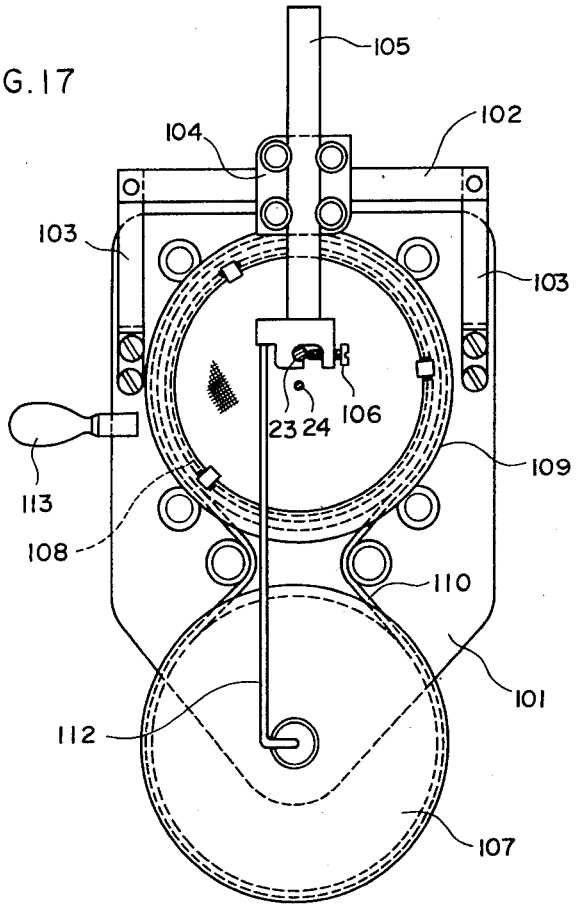
FIG. 17 is a plan view of an embroidering apparatus according to another embodiment.
Figure 18:
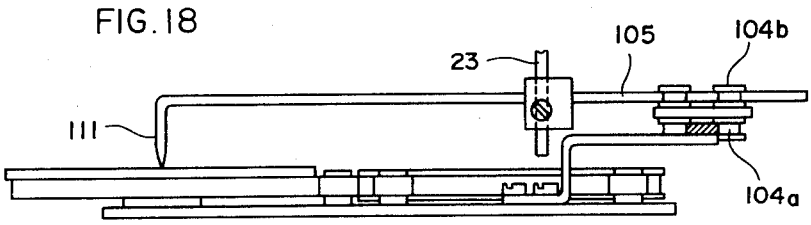
FIG. 18 is a righthand side elevational view of the embroidering apparatus shown in FIG. 17.

According to another embodiment shown in FIGS. 17 and 18, an embroidering apparatus comprises a body 101 on which there is mounted a rail 102 supported at ends thereof on a pair of supports 103, 103 fixed to the body 101, the rail 102 being spaced upwardly from the body 101. The runner assembly 104 comprises a pair of upper and lower runners 104*b*, 104*a*, the lower runner 104*a* supporting the rail 102 so as to allow the latter to be movable relatively to the lower runner 104*a*. A rail 105 which extends at a right angle to the rail 102 is movably supported on the upper runner 104*b*, and is secured at one end thereof to the presser bar 23 of the sewing machine by a set screw 106 so as to lie parallel to the bed 21 of the sewing machine. The body 101 supports thereon a circular table 107 and an annular support frame 109 with an embroidery frame 108 attached thereto, the table 107 and the support frame 109 being connected by an endless belt 110 disposed therearound. A rod 112 is fixed endwise to the rail 105 and has a tracing needle 111 disposed over and oriented to the table 107. In operation, the embroidery frame 108 can be rotated and moved around by rotating and moving around the table 107, or by rotating the table 107 and moving the body 101 with a grip handle 113 attached to the body 101. The embroidering apparatus shown in FIGS. 17 and 18 is move advantageous than the foregoing embroidering apparatus 25 in that only two rails 102, 105 are required and no separate fixed member is needed.

Figure 19:
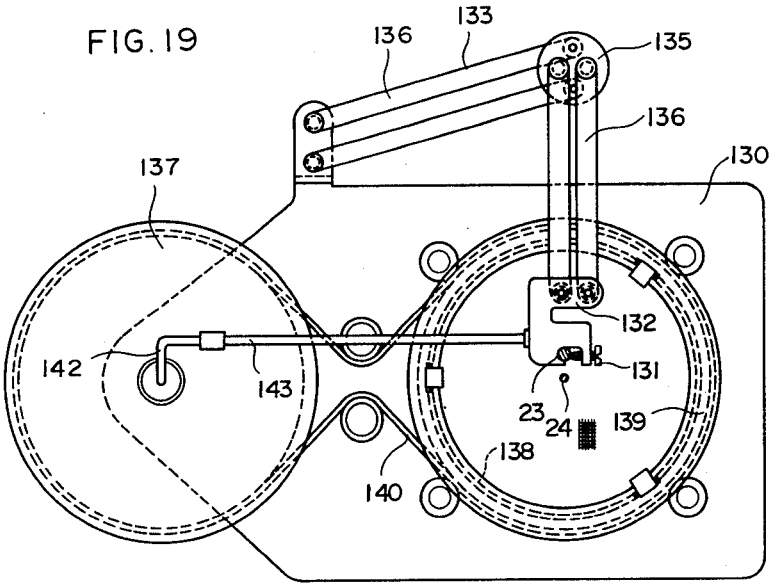
FIG. 19 is a plan view of an embroidering apparatus according to another embodiment.
Figure 20:
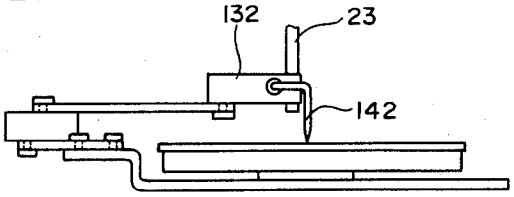
FIG. 20 is a front elevational view of the embroidering apparatus shown in FIG. 19.

FIGS. 19 and 20 illustrate an embroidering apparatus according to another embodiment. The apparatus comprises a body 130 operatively coupled by a pantograph mechanism 133 to a fixed member 132 secured to the presser bar 23 by a set screw 131. The pantograph mechanism 133 is extensible and retractable to allow back-and-forth and lateral movement of the body 130. The pantograph mechanism 133 comprises a disk-shaped intermediate member 135 and two sets of parallel links 136 operatively connected between the intermediate member 135 and the fixed member 132 and between the intermediate member 135 and the body 130, respectively. Pantograph mechanisms of known constructions may be used in place of the illustrated pantograph mechanism. The body 130 supports thereon a table 137 and a support frame 139 to which an embroidery frame 138 is attached, there being an endless belt 140 disposed around the table 137 and the support frame 139 for transmitting rotative power from the former to the latter. A rod 143 with a tracing needle 142 attached is supported on the fixed member 132, the tracing needle 142 being directed toward the table 137.

Although certain preferred embodiment have been shown and described in detail, it should be understood that many changes and modifications may be made therein without departing from the scope of the appended claims.

What is claimed is:

1. An embroidering apparatus for use with a sewing machine having a needle provided at a predetermined position, comprising:
   - a table movably supported in a plane including at least two intersecting directions on which an original pattern is to be placed,
   - an embroidery frame associated with and movable in the direction of the movement of said table responsively thereto, and
   - a tracing needle having the tip end thereof positioned at a fixed position and said tip end oriented to said original pattern on said table,
   - moving means for simultaneously moving said embroidery frame and said table, and
   - stopper means for selectively prohibiting movement by said moving means in one of the two intersecting directions.

2. An embroidering apparatus in accordance with claim 1, including guide rails disposed in an intersecting relation and means provided associated with both said intersecting guide rails and said embroidery frame for moving said embroidery frame along said intersecting guide rails.

3. An embroidering apparatus in accordance with claim 1, including a pantograph having one end fixed and the other end connected to said embroidery frame and said table for movement thereof through contraction and expansion thereof.

4. An embroidering apparatus according to claim 1, 2 or 3, including a body on which said embroidery frame and said table are supported.

5. An embroidering apparatus according to claim 2, one of said guide rails comprising a pair of parallel rail members secured to a body on which said embroidery frame and said table are supported, the other guide rail being movably supported on a runner mounted on a fixed member secured to a presser bar of the sewing machine, and said rail members being movably supported by respective runners on said other guide rail at ends thereof.

6. An embroidering apparatus according to claim 5, said other guide rail being rotatably supported on said runner secured to said fixed member.

7. An embroidering apparatus according to claim 5, said last-mentioned runners being rotatably supported on said other guide rail.

8. An embroidering apparatus according to any one of claims 1 to 3, further comprising a fixed member secured to a presser bar of the sewing machine and including a rod attached to said fixed member and supporting said tracing needle.

9. An embroidering apparatus according to claim 2, including a runner assembly comprising a pair of upper and lower runners on which said guide rails are movably supported respectively, one of said guide rails being fixed to a body on which said embroidery frame and said table are supported, and the other guide rail being secured to a presser bar of the sewing machine.

10. An embroidering apparatus according to claim 5 or 9, wherein said stopper means comprises means for fixing said runners in position.

11. An embroidering apparatus according to claim 10, said stopper means comprising a pair of caps movably mounted on each of said guide rails for sandwiching each of said runners.

12. An embroidering apparatus according to claim 10, said stopper means comprising a cam block rotatably mounted on each of said runners and having a handle lever actuatable to turn the cam block into pressing engagement with each of said guide rails.

13. An embroidering apparatus according to claim 10, said stopper means comprising threaded rods threaded through said runners and having handle levers which can be turned to press ends of said threaded rods against said guide rails.

14. An embroidering apparatus according to claim 4, including a support frame to which said embroidery frame is attached.

15. An embroidering apparatus according to claim 14, said support frame having on an upper inner peripheral edge thereof an attachment projection having a first engagement portion on its upper surface, said embroidery frame being made of plastics and having a flexible clip including a second engagement portion engageable with said first engagement portion, said embroidery frame being fitted in said support frame and held against said attachment projection, with said first and second engagement portions held in interfitting engagement with each other.

16. An embroidering apparatus according to claim 15, said attachment projection extending fully along said upper inner peripheral edge of said support frame.

17. An embroidering apparatus according to claim 15, / said embroidery frame comprising inner and outer frame members for sandwiching a piece of cloth therebetween, said clip being mounted on said inner frame member.

18. An embroidering apparatus according to claim 14, said support frame having on an upper inner peripheral edge thereof an attachment projection provided first engagement portion on its lower surface, said embroidery frame being made of plastics and having in an upper surface thereof a second engagement portion for interfitting engagement with said first engagement portion.

19. An embroidering apparatus according to claim 14, said embroidery frame being shaped to allow a piece of cloth to be sandwiched between said embroidery frame and said support frame.

20. An embroidering apparatus according to claim 4, said embroidery frame and said table being rotatable, including means for transmitting rotative power from said table to said embroidery frame.

21. An embroidering apparatus according to claim 14, said support frame and said table being rotatable, including means for transmitting rotative power from said table to said support frame.

22. An embroidering apparatus in accordance with claim 20 or 21, said tip end of said tracing needle being fixed such that the same may be positioned at the center of rotation of said table when said needle of said sewing machine is brought to the center of rotation of said embroidery frame.

23. An embroidering apparatus in accordance with claim 20 or 21, said needle of said sewing machine being brought to the center of rotation of said embroidery frame when the tip end of said tracing needle is brought to the center of rotation of said table.

24. An embroidering apparatus according to claim 21, said body having a cylindrical portion on which said support frame is supported.

25. An embroidering apparatus according to claim 21, including a device for locking said support frame against rotation.

26. An embroidering apparatus according to claim 25, including a roller held against said endless belt between said table and said support frame, said roller being movable by said locking device to tighten said belt until said support frame is fastened against rotation.

27. An embroidering apparatus according to claim 26, said locking device comprising a cam pivotally supported on said body and held in engagement with a member on which said roller is rotatably mounted, said cam including a handle lever actuatable to turn the cam.

28. An embroidering apparatus according to claim 27, said member having a ridge, and said cam having grooves receptive therein of said ridge when said support frame is rendered rotatable and held against rotation, respectively.

29. An embroidering apparatus according to claim 26, said locking device comprising a channel-shaped member on which said roller is rotatably mounted, a pair of spaced projections mounted on said body, a threaded rod secured to said channel-shaped member and extending through said pair of spaced projections, and a dial disposed between said projections and held in threaded engagement with said threaded rod.

30. An embroidering apparatus according to claim 26, said locking device comprising a lever supporting on one end thereof said roller for rotation about its own axis and pivotally mounted at its center on said body.

31. An embroidering apparatus according to claim 25, including a locking device comprising a pointed projection disposed for biting engagement with one of said support frame, table, and transmitting means.

32. An embroidering apparatus according to claim 25, said locking device comprising a gear drive device including a transmission gear for transmitting rotative power from said table to said support frame and a ratchet movable into and out of engagement with said transmission gear.

33. An embroidery apparatus according to claim 1 wherein said stopper means includes means for permitting movement by said moving mechanism in the other of said two intersecting directions when movement in said one direction is selectively prohibited by said stopper means.

34. An embroidering apparatus for use with a sewing machine having a needle provided at a predetermined position, comprising:

a table movably supported in a plane including at least two intersecting directions on which an original pattern is to be placed, an embroidery frame associated with and movable in the direction of the movement of said table responsively thereto, and a tracing needle having the tip end thereof positioned at a fixed position and said tip end oriented to said original pattern on said table, said embroidery frame and said table being rotatably mounted, and lock means for restricting the rotation of said embroidery frame.

35. An embroidering apparatus according to claim 33 further comprising coupling means for rotationally coupling said embroidery frame and said table, thereby to rotate said embroidery frame responsively to rotation of said table having the original pattern thereon.

36. An embroidering apparatus in a sewing machine having a needle provided at a predetermined position, comprising:

a table movably supported in a plane including at least two intersecting directions on which an original pattern is to be placed, an embroidery frame associated with and movable in the direction of the movement of said table responsively thereto, a body on which said embroidery frame and said table are supported, said embroidery frame and said table being rotatable, a tracing needle having the tip end thereof positioned at a fixed position and said tip end oriented to said original pattern on said table, moving mechanism for simultaneously moving said embroidery frame and said table, including means for transmitting rotative power from said table to said embroidery frame, and stopper means for prohibiting movement by said moving mechanism.

37. An embroidery apparatus in a sewing machine having a needle provided at a predetermined position, comprising:

a table movably supported in a plane including at least two intersecting directions on which an original pattern is to be placed, an embroidery frame associated with and movable in the direction of the movement of said table responsively thereto, a body on which said embroidery frame and said table are supported, a support frame to which said embroidery frame is attached, said support frame and said table being rotatable and including means for transmitting rotative power between said table and said support frame, a tracing needle having the tip end thereof positioned at a fixed position and said tip end oriented to said original pattern on said table, moving mechanism for simultaneously moving said embroidery frame and said table, and stopper means for prohibiting movement by said moving mechanism.

* * * * *